US009063473B2

(12) United States Patent
Kato et al.

(10) Patent No.: US 9,063,473 B2
(45) Date of Patent: Jun. 23, 2015

(54) IMAGE FORMING APPARATUS

(71) Applicants: Shuichi Kato, Nagoya (JP); Toshio Furukawa, Nagoya (JP)

(72) Inventors: Shuichi Kato, Nagoya (JP); Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 71 days.

(21) Appl. No.: 14/040,120

(22) Filed: Sep. 27, 2013

(65) Prior Publication Data

US 2014/0093265 A1 Apr. 3, 2014

(30) Foreign Application Priority Data

Sep. 28, 2012 (JP) ..... 2012-216670

(51) Int. Cl.
*G03G 15/16* (2006.01)

(52) U.S. Cl.
CPC ..... *G03G 15/161* (2013.01); *G03G 2221/0073* (2013.01)

(58) Field of Classification Search
CPC ..... G03G 21/0005; G03G 2221/0005; G03G 2221/0073; G03G 2215/1647; G03G 2215/1657; G03G 2215/1661; G03G 15/16
USPC ..... 399/66, 71, 101
See application file for complete search history.

(56) References Cited

FOREIGN PATENT DOCUMENTS

JP 2000-250330 A 9/2000

*Primary Examiner* — Christ Mahoney
(74) *Attorney, Agent, or Firm* — Banner & Witcoff, Ltd.

(57) ABSTRACT

An image forming apparatus including: an intermediate transfer member configured to transfer the developer images on the plurality of photosensitive members; a secondary transfer member configured to transfer the developer images transferred onto the intermediate transfer member onto a recording sheet; a plurality of primary holding rollers provided to each of the plurality of photosensitive members, respectively; a collecting unit configured to collect developer remaining on the intermediate transfer member; and a control device configured to control biases applied to the secondary transfer member and the plurality of primary holding rollers, wherein, after printing control terminates, the control device is configured to perform cleaning control in which biases having opposite polarities to biases during the printing control are applied to the plurality of primary holding rollers and the secondary transfer member.

7 Claims, 16 Drawing Sheets

| | POTENTIAL Vp OF PHOTOSENSITIVE DRUM | POTENTIAL Vt OF PRIMARY CLEANING ROLLER | POTENTIAL Vt OF SECONDARY TRANSFER ROLLER | POTENTIAL Vs OF SECONDARY CLEANING ROLLER |
|---|---|---|---|---|
| PRINTING MODE | V1 | -V2 | -V3 | -V4 |
| FULL DISCHARGE MODE | V5 | V6 | V7 | V8 |
| ENERGY SAVING MODE | V5 | V6 | V9 | V10 |
| NEGATIVELY-CHARGED-TONER DISCHARGE MODE | V5 | V6 | -V3 | -V4 |

FIG. 4

| | POTENTIAL Vp OF PHOTOSENSITIVE DRUM | POTENTIAL Vl OF PRIMARY CLEANING ROLLER | POTENTIAL Vt OF SECONDARY TRANSFER ROLLER | POTENTIAL Vs OF SECONDARY CLEANING ROLLER |
|---|---|---|---|---|
| PRINTING MODE | V1 | −V2 | −V3 | −V4 |
| FULL DISCHARGE MODE | V5 | V6 | V7 | V8 |
| ENERGY SAVING MODE | V5 | V6 | V9 | V10 |
| NEGATIVELY-CHARGED-TONER DISCHARGE MODE | V5 | V6 | −V3 | −V4 |

FIG. 8

| | POTENTIAL Vp OF PHOTOSENSITIVE DRUM | POTENTIAL Vf OF PRIMARY CLEANING ROLLER | POTENTIAL Vt OF SECONDARY TRANSFER ROLLER | POTENTIAL Vs OF SECONDARY CLEANING ROLLER |
|---|---|---|---|---|
| PRINTING MODE | V1 | −V2 | −V3 | −V4 |
| PRIMARY TONER DISCHARGE MODE | V5 | V6 | V7 | −V4 |
| SECONDARY TONER DISCHARGE MODE | V5 | V6 | V7 | V8 |

IMAGE FORMING APPARATUS

CROSS-REFERENCE TO RELATED APPLICATIONS

This application claims priority from Japanese Patent Application No. 2012-216670 filed on Sep. 28, 2012, the entire contents of which are incorporated herein by reference.

TECHNICAL FIELD

Aspects of the present invention relate to an intermediate transfer type image forming apparatus.

BACKGROUND

In related art, as an intermediate transfer type image forming apparatus, there is known an image forming apparatus which includes a plurality of photosensitive drums, an intermediate transfer belt onto which toner images on the plurality of photosensitive drums are transferred, and a secondary transfer roller that transfers a toner image on the intermediate transfer belt onto a paper sheet. Specifically, this image forming apparatus includes a plurality of cleaning units that is provided correspondingly to the photosensitive drums, respectively, in order to collect toner remaining on the photosensitive drums, a belt cleaning unit for collecting toner remaining on the intermediate transfer belt, and a toner holding roller for temporarily holding toner having moved onto the secondary transfer roller.

Therefore, in this technology, in a case where toner has moved from the intermediate transfer belt onto the secondary transfer roller during the printing, the toner having moved onto the secondary transfer roller is temporarily held by the toner holding roller, whereby the toner on the secondary transfer roller is suppressed from being attached to a paper sheet. Also, toner remaining on each photosensitive drum (toner having not contributed to image forming) is collected into a corresponding cleaning unit.

SUMMARY

However, in the above described configuration, since there is provided the plurality of cleaning units corresponding to the plurality of photosensitive drums, there is a problem in which the apparatus increases in size.

Accordingly, aspects of the present invention provide a compact image forming apparatus capable of successfully cleaning developer off photosensitive members and a secondary transfer roller member.

According to a first aspect of the present invention, there is provided an image forming apparatus including: a plurality of photosensitive members configured to carry developer images: an intermediate transfer member configured to transfer the developer images on the plurality of photosensitive members; a secondary transfer member configured to transfer the developer images transferred onto the intermediate transfer member onto a recording sheet; a plurality of primary holding rollers provided to each of the plurality of photosensitive members, respectively, and configured to temporarily hold developer remaining on the photosensitive members; a collecting unit configured to collect developer remaining on the intermediate transfer member; and a control device configured to control biases applied to the secondary transfer member and the plurality of primary holding rollers, wherein, after printing control terminates, the control device is configured to perform cleaning control in which biases having opposite polarities to biases during the printing control are applied to the plurality of primary holding rollers and the secondary transfer member.

Accordingly, it is possible to provide a compact image forming apparatus capable of successfully cleaning developer off photosensitive members and a secondary transfer member.

BRIEF DESCRIPTION OF DRAWINGS

FIG. 4 is a table illustrating the potential relation between components in each control mode:

FIG. 8 is a table illustrating the potential relation between components in control modes of the second embodiment:

DETAILED DESCRIPTION

First Embodiment

Figure 1:
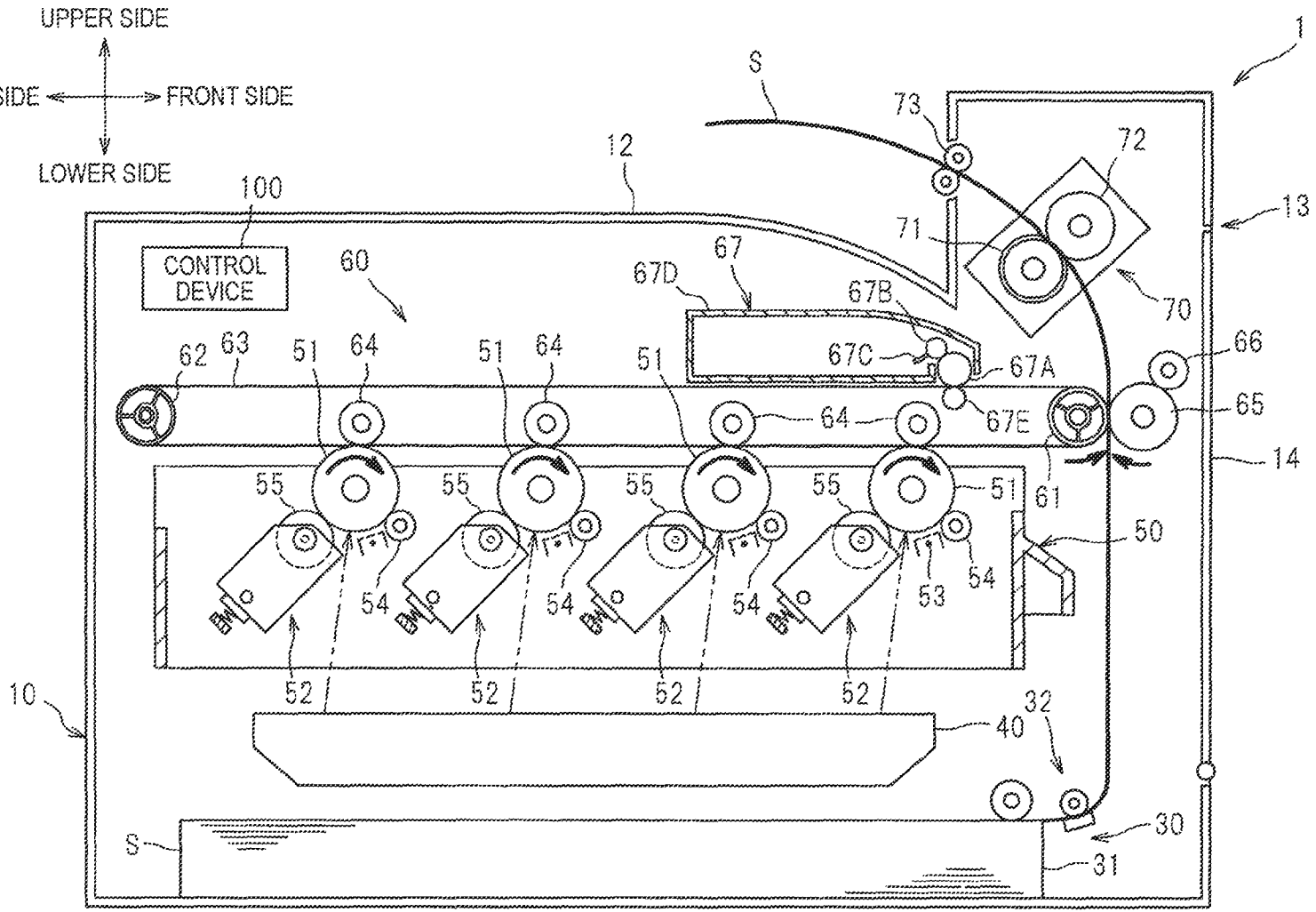
FIG. 1 is a view illustrating a color printer according to a first embodiment of the present invention.

Hereinafter, as an example of an image forming apparatus according to a first embodiment of the present invention, a color printer will be described in detail with reference to appropriate drawings. In the following description, directions of the color printer refer to the directions as seen from a user facing to the color printer during its use. To be more specific, referring to FIG. 1, a right-side direction and a left-side direction of the drawing sheet are referred to as a "front side" and a "rear side" of the color printer, respectively. Also, a direction toward the viewer of FIG. 1 is referred to as a "left side", and a direction away from a viewer of FIG. 1 as a "right side". An upward and downward direction in FIG. 1 is referred to as an "upper-lower direction".

As shown in FIG. 1, a color printer 1 includes a paper feeding unit 30, a scanner unit 40, a drawer 50, a transfer unit 60, a fixing unit 70, and a control device 100 inside a main apparatus body 10.

At the top of the main apparatus body 10, there is provided a paper discharge tray 12 on which paper sheets S are mounted as examples of a recording sheet discharged from the main apparatus body 10. Also, at the front wall of the main apparatus body 10, an opening 13 is formed for pulling the drawer 50 out of the main apparatus body 10, and a front cover 14 for opening and closing the opening 13 is rotatably provided.

The paper feeding unit 30 is provided at a lower portion in the main apparatus body 10, and includes a paper feed tray 31 for accommodating paper sheets S, and a paper feeding mechanism 32 for conveying paper sheets S from the paper feed tray 31 to a transfer position (between an intermediate transfer belt 63 and a secondary transfer roller 65). The paper sheets S in the paper feed tray 31 are conveyed to the transfer position one by one by the paper feeding mechanism 32.

The scanner unit 40 is provided above the paper feeding unit 30, and includes a laser emission unit, a polygon mirror, a lens, reflective mirrors, and so on (which are not shown). Further, the scanner unit 40 irradiates laser beams onto the surfaces of photosensitive drums 51 which are examples of a photosensitive member, through paths shown by two-dot chain lines by high-speed scan.

The drawer 50 is disposed below the intermediate transfer belt 63 (between the intermediate transfer belt 63 and the scanner unit 40), is supported to be movable substantially in a front-rear direction with respect to the main apparatus body 10, and can be pulled out from the opening 13 of the main apparatus body 10 toward the front side.

In the drawer 50, there are provided four photosensitive drums 51, four developing cartridges 52, four chargers 53, and four primary cleaning rollers 54 which are examples of a primary holding roller. The primary cleaning rollers 54 are provided correspondingly to the four photosensitive drums 51, respectively, and have a function of temporarily holding positively chargeable toner as an example of developer remaining on the photosensitive drums 51. In each developing cartridge 52, there are provided a developing roller 55, a known feeding roller (not shown), a layer-thickness regulating blade, a toner container, etc.

The transfer unit 60 is provided on the drawer 50, and includes a drive roller 61, a driven roller 62, the intermediate transfer belt 63 and four primary transfer rollers 64 which are an example of an intermediate transfer member, the secondary transfer roller 65 which is an example of a secondary transfer member, a secondary cleaning roller 66 which is an example of a secondary holding roller, and a collecting unit 67. The intermediate transfer belt 63 is an endless belt which is stretched between the drive roller 61 and the driven roller 62, and is disposed to face the plurality of photosensitive drums 51, and can rotate counterclockwise as seen in FIG. 1.

The four primary transfer rollers 64 are disposed inside the intermediate transfer belt 63 such that the intermediate transfer belt 63 is interposed between the primary transfer rollers 64 and the photosensitive drums 51. The secondary transfer roller 65 is disposed on the downstream side with respect to the photosensitive drums 51 in the rotation direction of the intermediate transfer belt 63 (hereinafter, referred to as a "belt rotation direction"), specifically, in front of the intermediate transfer belt 63, such that the intermediate transfer belt 63 is interposed between the secondary transfer roller 65 and the drive roller 61. Also, the drive roller 61 is connected to a ground (not shown).

The secondary cleaning roller 66 is provided close to the secondary transfer roller 65, and has a function of temporarily holding toner remaining on the secondary transfer roller 65. The collecting unit 67 is provided on the intermediate transfer belt 63 (on the downstream side with respect to the secondary transfer roller 65 in the belt rotation direction).

Specifically, the collecting unit 67 includes a first collecting roller 67A which is in sliding contact with the intermediate transfer belt 63, a second collecting roller 67B which is in sliding contact with the first collecting roller 67A, a blade 67C which is in sliding contact with the second collecting roller 67B, a housing 67D, and a backup roller 67E which is disposed such that the intermediate transfer belt 63 is interposed between the backup roller 67E and the first collecting roller 67A.

In the drawer 50 and the transfer unit 60 as described above, first, the surfaces of the photosensitive drums 51 are uniformly charged by the chargers 53, and then are exposed by the scanner unit 40, whereby electrostatic latent images based on image data are formed on the photosensitive drums 51. Further, the toner in the toner containers is carried on the surfaces of the developing rollers 55 through the feeding rollers.

The toner carried on the surfaces of the developing rollers 55 is fed from the developing rollers 55 to the electrostatic latent images on the photosensitive drums 51. Therefore, the electrostatic latent images are visualized, that is, toner images are formed (carried) on the photosensitive drums 51. If primary transfer biases are applied between the photosensitive drums 51 and the primary transfer rollers 64, the toner images of individual colors formed on the photosensitive drums 51 are (primarily) transferred onto the intermediate transfer belt 63.

Also, during this primary transfer, some of the toner images of the photosensitive drums 51 may not be transferred onto the paper sheet S but may remain on the photosensitive drums 51. In this case, primary cleaning biases are applied between the primary cleaning rollers 54 and the photosensitive drums 51, whereby the toner remaining on the photosensitive drums 51 is collected by the primary cleaning rollers 54.

When a paper sheet S conveyed from the paper feeding unit 30 passes the transfer position between the intermediate transfer belt 63 and the secondary transfer roller 65, a second transfer bias is applied between the secondary transfer roller 65 and the drive roller 61, whereby the toner image on the intermediate transfer belt 63 is (secondarily) transferred onto the paper sheet S.

Also, during this secondary transfer, the toner on the intermediate transfer belt 63 may be transferred onto the secondary transfer roller 65. In this case, a secondary transfer bias is applied between the secondary cleaning roller 66 and the secondary transfer roller 65, whereby the toner on the secondary transfer roller 65 is collected by the secondary cleaning roller 66.

Also, during this secondary transfer, some of the toner image on the intermediate transfer belt 63 may not be transferred onto the paper sheet S but may remain on the intermediate transfer belt 63. In this case, a collecting bias is applied between the first collecting roller 67A and the backup roller 67E, whereby the toner remaining on the intermediate transfer belt 63 is collected by the first collecting roller 67A. The toner collected by the first collecting roller 67A is collected by the second collecting roller 67B, is scraped off the second collecting roller 67B by the blade 67C, and is stored in the housing 67D.

The fixing unit 70 is provided on the upper front side with respect to the transfer unit 60, and includes a heating roller 71, a pressing roller 72 that is disposed to face the heating roller 71 and presses the heating roller 71, and discharging rollers 73 that discharge the paper sheet S having been subject to fixing, to the outside of the main apparatus body 10. In the fixing unit 70, when the paper sheet S having the toner image transferred thereon passes between the heating roller 71 and the pressing roller 72, the toner image is thermally fixed, and then the paper sheet S is discharged to the outside of the main apparatus body 10 by the discharging rollers 73 so as to be loaded on the paper discharge tray 12.

The control device 100 includes a CPU, a ROM, a RAM, and so on, and can receive a printing command (print data) and control the paper feeding unit 30, the scanner unit 40, the internal components of the drawer 50, the transfer unit 60, the fixing unit 70, and a known contact/separation mechanism 110 (see FIG. 2), thereby performing a known printing mode (printing control) and a cleaning mode (cleaning control) according to the present invention.

Figure 2:
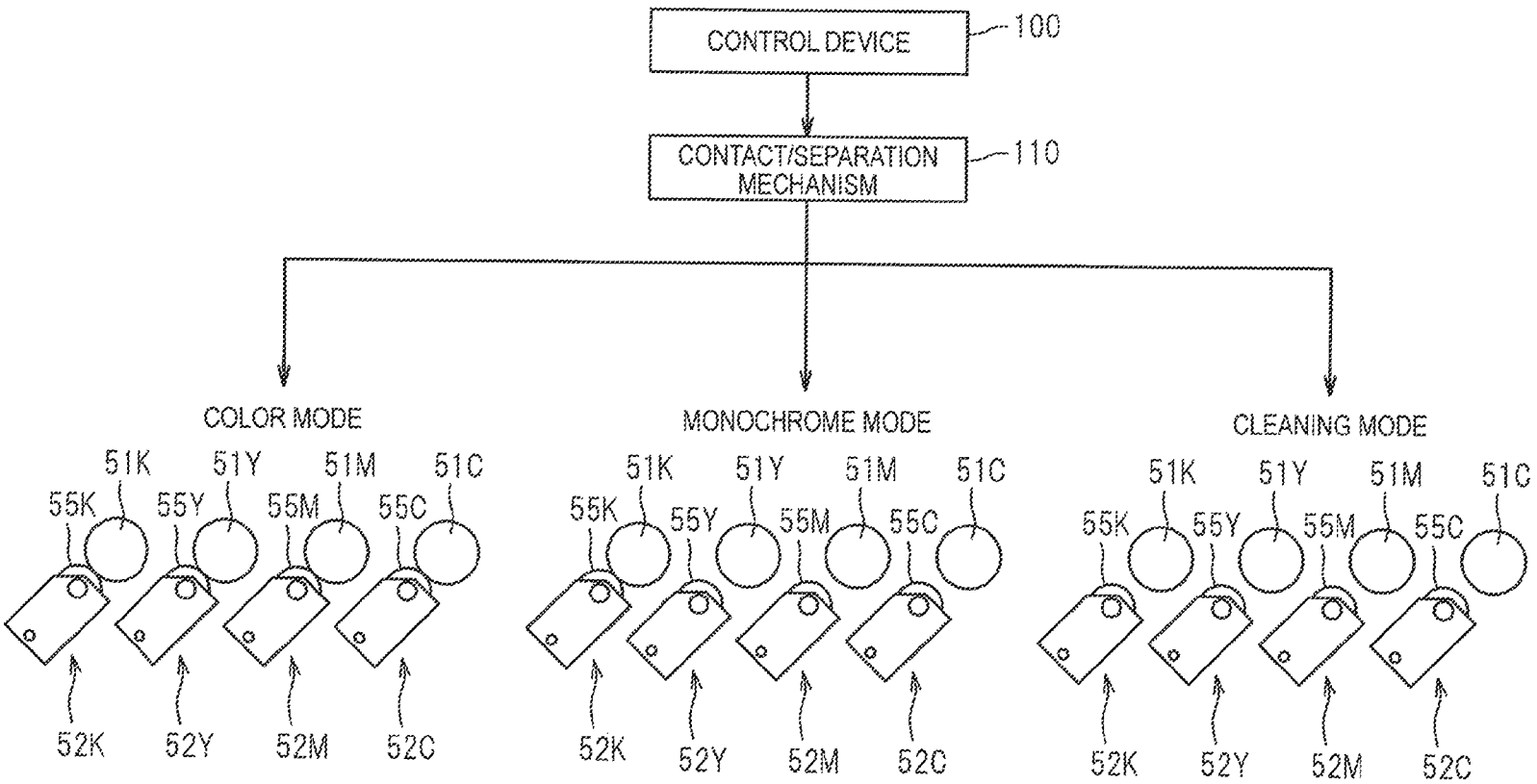
FIG. 2 is a view illustrating the relation between a contact/separation mechanism and control modes.

As shown in FIG. 2, the control device 100 can control the known contact/separation mechanism 110 for bringing the developing rollers 55 into contact with the photosensitive drums 51 or separating the developing rollers 55 from the photosensitive drums 51, thereby performing a color mode, a monochrome mode, and the cleaning mode. Also, in this specification and the drawings, in a case of specifying the photosensitive drums 51, the developing rollers 55, and the like corresponding to colors of toner, symbols "K", "Y", "M", and "C" corresponding to black, yellow, magenta, and cyan are added to their reference symbols.

Specifically, when the color mode is performed, the control device 100 controls the contact/separation mechanism 110 such that all developing rollers 55K, 55Y, 55M, and 55C come into contact with corresponding photosensitive drums 51K, 51Y, 51M, and 51C, respectively. Also, when the monochrome mode is performed, the control device 100 controls the contact/separation mechanism 110 such that only the developing roller 55K for black comes into contact with the photosensitive drum 51K, and the developing rollers 55Y, 55M, and 55C of the other three colors are separated from corresponding photosensitive drums 51Y, 51M, and 51C.

Further, when the cleaning mode is performed, the control device 100 controls the contact/separation mechanism 110 such that all developing rollers 55K, 55Y, 55M, and 55C are separated from corresponding photosensitive drums 51K, 51Y, 55M, and 51C, respectively. Also, in the cleaning mode, the control device 100 controls the primary transfer biases, the secondary transfer bias, the primary cleaning biases, the secondary cleaning bias, and the collecting bias described above as follows.

Here, the term "bias" means an electric force (potential difference) for moving toner in one direction, and biases are controlled by controlling currents and voltages.

<Cleaning Mode>

Hereinafter, the cleaning mode will be described in detail.

Figure 3:
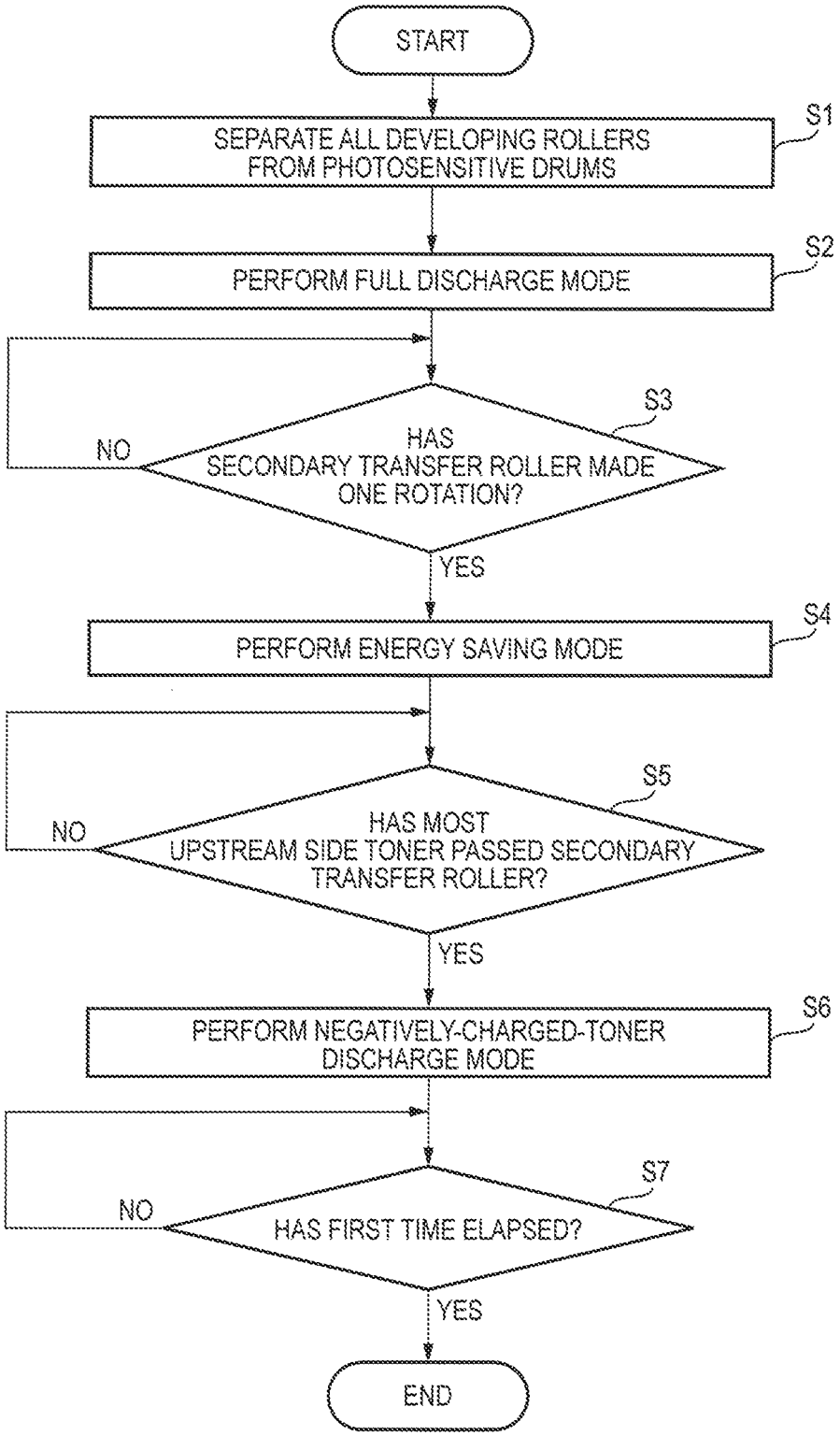
FIG. 3 is a flow chart illustrating a cleaning mode according to the first embodiment.

As shown in FIG. 3, if the printing mode terminates ("START"), first, in STEP S1, the control device 100 separates all developing rollers 55 from the photosensitive drums 51. After STEP S1, in STEP S2, the control device 100 performs a full discharge mode.

Figure 5A:
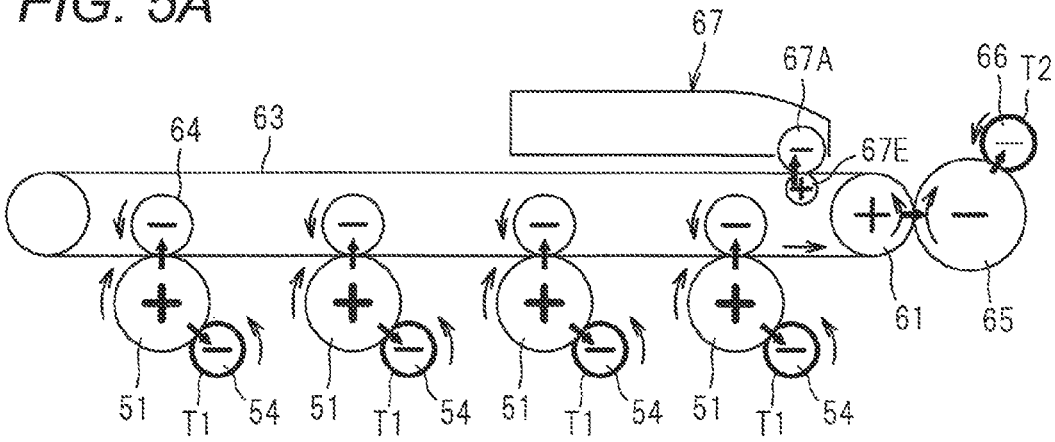
FIG. 5A is a view illustrating biases during printing control.

Here, since control on biases in the printing mode is known, this control will not be described in detail. However, in brief, control on biases in the printing mode is performed as shown in FIGS. 4 and 5A. Specifically, in the printing mode, as shown in FIG. 5A, each of the primary transfer biases, the secondary transfer bias, the primary cleaning biases, the secondary cleaning bias, and the collecting bias acts to work in a direction from a symbol "+" toward a symbol "−" or in a direction from a bold symbol "−" toward a thin symbol "−". Here, in the following FIGS. 5A to 5C and FIGS. 6A and 6B, a larger potential is shown by a bolder symbol "+" or "−".

As a result of STEP S2, toner T1 remaining on the photosensitive drums 51 is collected by and held on the primary cleaning rollers 54, and toner T2 on the secondary transfer roller 65 is collected by and held on the secondary cleaning roller 66.

Also, in FIG. 4, only the potentials of members which are controlled in the cleaning mode such that they are different from those during the printing mode are illustrated. In FIG. 4, a potential V1 is larger than a potential −V2, and a potential −V3 is larger than a potential −V4.

Figure 5B:
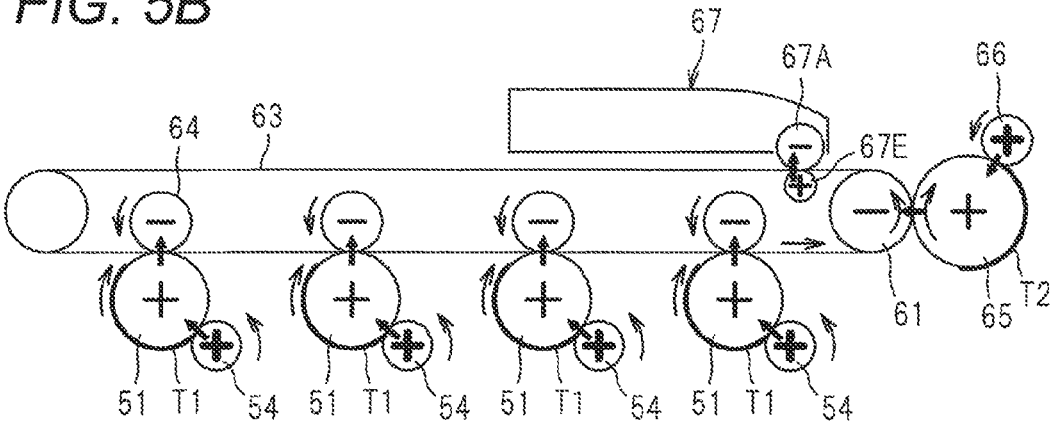
FIG. 5B is a view illustrating biases during a full discharge mode.

Also, in the full discharge mode, the control device 100 performs control such that the primary cleaning biases, the secondary cleaning bias, and the secondary transfer bias have the opposite polarities to those in the printing mode as shown in FIG. 5B. Specifically, in the full discharge mode, as shown in FIG. 4, the control device 100 controls voltages to be applied to the chargers 53 such that the potential Vp of the photosensitive drums 51 becomes a potential V5 smaller than the potential V1 in the printing mode, and controls voltages to be applied to the primary cleaning rollers 54 such that the potential Vf of the primary cleaning rollers 54 becomes a positive potential V6 larger than the potential V5.

Also, the control device 100 controls a voltage to be applied to the secondary transfer roller 65 such that the potential difference of the secondary transfer roller 65 from the drive roller 61 becomes a positive potential V7, and controls a voltage to be applied to the secondary cleaning roller 66 such that the potential difference (potential Vs) of the secondary cleaning roller 66 from the drive roller 61 becomes a positive potential V8 larger than the potential V7.

Figure 5C:
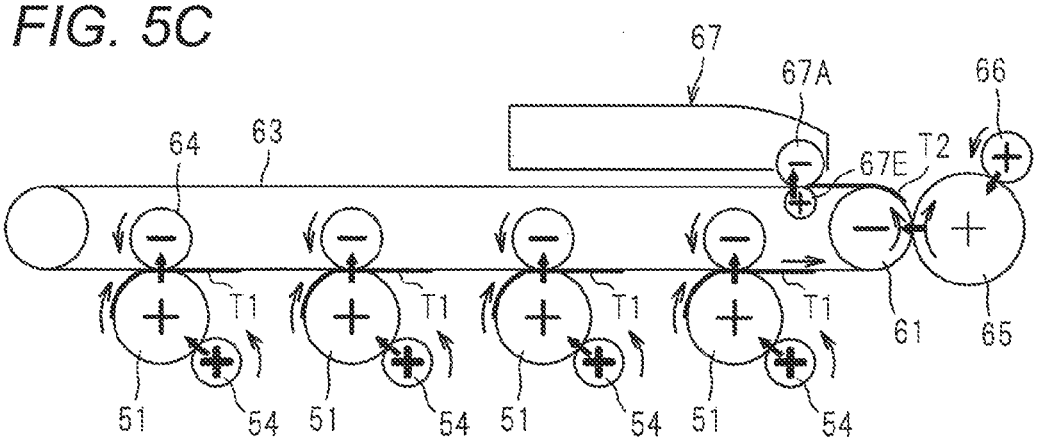
FIG. 5C is a view illustrating biases during an energy saving mode.
Figure 6A:
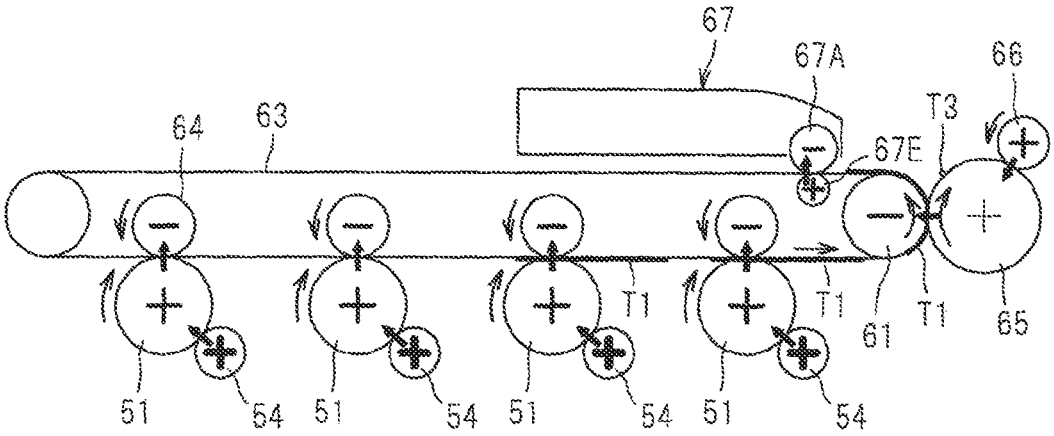
FIG. 6A is a view illustrating a state when toner which was on primary cleaning rollers is passing a secondary transfer roller.
Figure 6B:
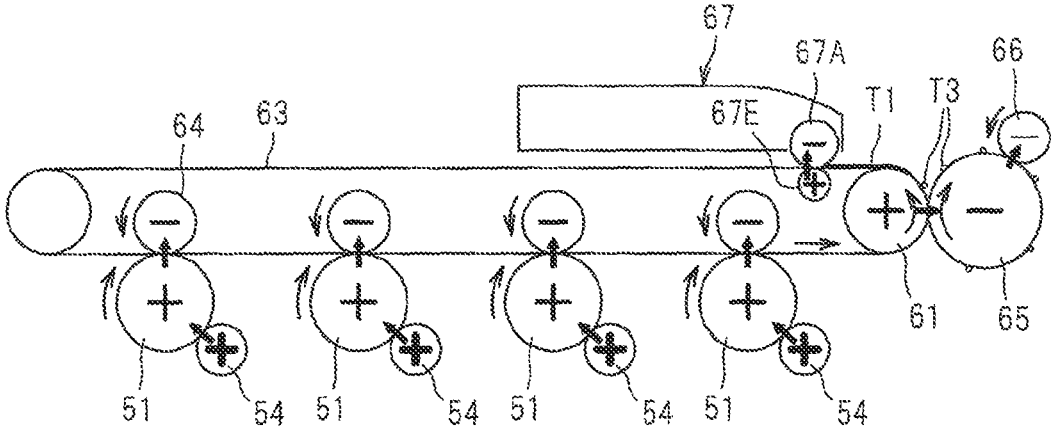
FIG. 6B is a view illustrating biases during a negatively-charged-toner discharge mode.

If the biases are controlled as described above, the toner T1 on the primary cleaning rollers 54 is discharged (transferred) onto the photosensitive drums 51, and the toner T2 on the secondary cleaning roller 66 is discharged onto the secondary transfer roller 65. Thereafter, as shown in FIGS. 5C, 6A, and 6B, the toner T1 on the photosensitive drums 51 and the toner T2 on the secondary transfer roller 65 are discharged onto the intermediate transfer belt 63 and then are collected by the collecting unit 67.

According to this configuration, it is possible to temporarily hold toner on the photosensitive drums 51 and the secondary transfer roller 65 by the primary cleaning rollers 54 and the secondary cleaning roller 66, respectively, and then collect the toner together by the collecting unit 67. Therefore, it is possible to successfully clean toner off the photosensitive drums 51 and the secondary transfer roller 65. Also, as compared to a structure in which a plurality of cleaning units for collecting toner on photosensitive drums (units having components such as containers for collecting toner) like in the related art, since only the primary cleaning rollers 54 for temporarily holding toner on the photosensitive drums 51 need to be provided, it is possible to downsize the apparatus.

Also, in the present embodiment, the full discharge mode is performed, that is, the timings to discharge toner from the primary cleaning rollers 54 and the secondary cleaning roller 66 are synchronized with each other, such that toner corresponding to the first one rotation of the secondary transfer roller 65 (the secondary cleaning roller 66) moves onto the intermediate transfer belt 63 before the toner T1 on the intermediate transfer belt 63, which corresponds to the first one rotation of each primary cleaning roller 54, passes the secondary transfer roller 65. Here, "toner corresponding to the first one rotation of the secondary transfer roller 65 (the secondary cleaning roller 66)" means, for example, toner which moves onto the intermediate transfer belt 63 by the first one rotation of the secondary transfer roller 65 (the secondary cleaning roller 66). Further, "the toner T1 which corresponds to the first one rotation of each primary cleaning roller 54" means, for example, toner which has moved onto the intermediate transfer belt 63 through each photosensitive drum 51 by the first one rotation of each primary cleaning roller 54.

Specifically, in a case where a distance from the most upstream side photosensitive drum 51 in the belt rotation direction to the secondary transfer roller 65, the diameters of the photosensitive drums 51 and the like, and so on, have a relation as shown in the drawings, effects as described above can be achieved by synchronizing the timings for discharging toner from the cleaning rollers 54 and 66. According to this configuration, on the intermediate transfer belt 63, since the toner T2 from the secondary transfer roller 65 is not overlapped on the toner T1 corresponding to the first one rotation of each primary cleaning roller 54 (that is, almost all toner collected by each primary cleaning roller 54), it is possible to facilitate collecting of toner by the collecting unit 67.

Referring to FIG. 3 again, after STEP S2, that is, after each bias corresponding to the full discharge mode is set, in STEP S3, the control device 100 determines whether the secondary transfer roller 65 has made one rotation, that is, whether toner attached on the entire circumference of the secondary transfer roller 65 (toner corresponding to one or more rotations of the secondary cleaning roller 66) has been discharged onto the intermediate transfer belt 63. Here, the determination on whether the secondary transfer roller 65 has made one rotation may be performed by determining whether a time corresponding to the first one rotation of the secondary transfer roller 65 has elapsed from the start of the cleaning mode.

In a case where it is determined in STEP S3 that the secondary transfer roller 65 has made one rotation ("YES"), in STEP S4, the control device 100 performs an energy saving mode. In the energy saving mode, as shown in FIGS. 4 and 5C, the control device 100 changes the potential Vt of the secondary transfer roller 65 to a potential V9 smaller than the potential V7 during the full discharge mode, and changes the potential Vs of the secondary cleaning roller 66 to a potential V10 smaller than the potential V8 during the full discharge mode and larger than the potential V9.

That is, in a case where toner on the secondary transfer roller 65 is moved onto the intermediate transfer belt 63, the control device 100 sets the secondary transfer bias to a first bias only for a time corresponding to the first one rotation of the secondary transfer roller 65, and then changes the secondary transfer bias to a second bias smaller than the first bias after the time corresponding to one rotation elapses. In other words, the effect of the secondary transfer bias is reduced. According to this configuration, after the secondary transfer roller 65 makes one rotation for the first time, the secondary transfer bias is reduced from the first bias to the second bias. Therefore, for example, as compared to a configuration in which the secondary transfer bias is maintained at the first bias even after one rotation, it is possible to suppress power consumption. Also, after the secondary transfer roller 65 makes one rotation for the first time, toner hardly remains on the secondary transfer roller 65. Therefore, even if the bias is reduced, there is no problem.

Also, in the present embodiment, in the full discharge mode and the energy saving mode, the secondary transfer bias is maintained in a direction from the secondary transfer roller 65 toward the drive roller 61. Therefore, as shown in FIG. 6A, when the toner T1 on the intermediate transfer belt 63, which corresponds to the first one rotation of each primary cleaning roller 54, passes the secondary transfer roller 65, a bias having the opposite polarity to that during the printing mode is applied to the secondary transfer roller 65. According to this configuration, it is possible to suppress the toner T1 having moved onto the intermediate transfer belt 63 by the first one rotation of each primary cleaning roller 54 from moving from the intermediate transfer belt 63 onto the secondary transfer roller 65.

Referring to FIG. 3 again, after STEP S4, that is, after each bias corresponding to the energy saving mode is set, in STEP S5, the control device 100 determines whether the toner T1 corresponding to the most upstream side photosensitive drum 51 in the belt rotation direction has passed the secondary transfer roller 65. Here, the determination on whether the most upstream side toner T1 has passed the secondary transfer roller 65 may be performed by determining whether a predetermined toner movement time (a time necessary for the toner T1 on the most upstream side primary cleaning roller 54 to completely pass the secondary transfer roller 65) has elapsed from the start time of the cleaning mode. Also, the predetermined toner movement time may be appropriately set by experiments, simulations, and so on.

In a case where it is determined in STEP S5 that the most upstream side toner T1 has passed the secondary transfer roller 65 ("YES"), in STEP S6, the control device 100 performs a negatively-charged-toner discharge mode. In the negatively-charged-toner discharge mode, the control device 100 changes the secondary transfer bias and the secondary cleaning bias to biases having the same polarities as those during the printing mode as shown in FIGS. 4 and 6B.

Specifically, the control device 100 changes the potential Vt of the secondary transfer roller 65 and the potential Vs of the secondary cleaning roller 66 to the same potentials −V3 and −V4 as those during the printing mode. According to this configuration, even in a case where toner T3, which is obtained by the toner T1 corresponding to the first one rotation of each primary cleaning roller 54 being converted when passing the secondary transfer roller 65 and which has a polarity (negative polarity) opposite to that of the toner T1, is reversely transferred onto the secondary transfer roller 65, it is possible to move the reversely transferred toner T3 from the secondary transfer roller 65 onto the intermediate transfer belt 63 and collect the toner T3 by the collecting unit 67.

Also, in the present embodiment, in the above described situation, the secondary cleaning bias acts in a direction from the secondary cleaning roller 66 toward the secondary transfer roller 65. Therefore, it is possible to suppress the negative toner T3 from being collected from the secondary transfer roller 65 onto the secondary cleaning roller 66.

Referring to FIG. 3 again, after STEP S6, that is, after each bias corresponding to the negatively-charged-toner discharge mode is set, in STEP S7, the control device 100 determines whether a first time has elapsed. Here, the first time is, for example, a time necessary for all of the negative toner T3 attached to the secondary transfer roller 65 to be collected by the collecting unit 67 after the negatively-charged-toner discharge mode starts, and may be appropriately set by experiments, simulations, and so on.

In a case where it is determined in STEP S7 that the first time has elapsed ("YES"), the control device 100 terminates the present control.

Second Embodiment

Subsequently, a second embodiment of the present invention will be described in detail with reference to appropriate drawings. Here, since the present embodiment is obtained by changing the control method of the control device 100 according to the above described first embodiment, components substantially identical to those of the first embodiment are denoted by the same reference symbols, and will not be described in detail.

A control device 100 according to the second embodiment is configured to control each bias in the cleaning mode such that toner on the secondary cleaning roller 66 moves onto the intermediate transfer belt 63 through the secondary transfer roller 65 at a timing after toner on the intermediate transfer belt 63, which corresponds to the first one rotation of each primary cleaning roller 54, has passed the secondary transfer roller 65.

Figure 7:
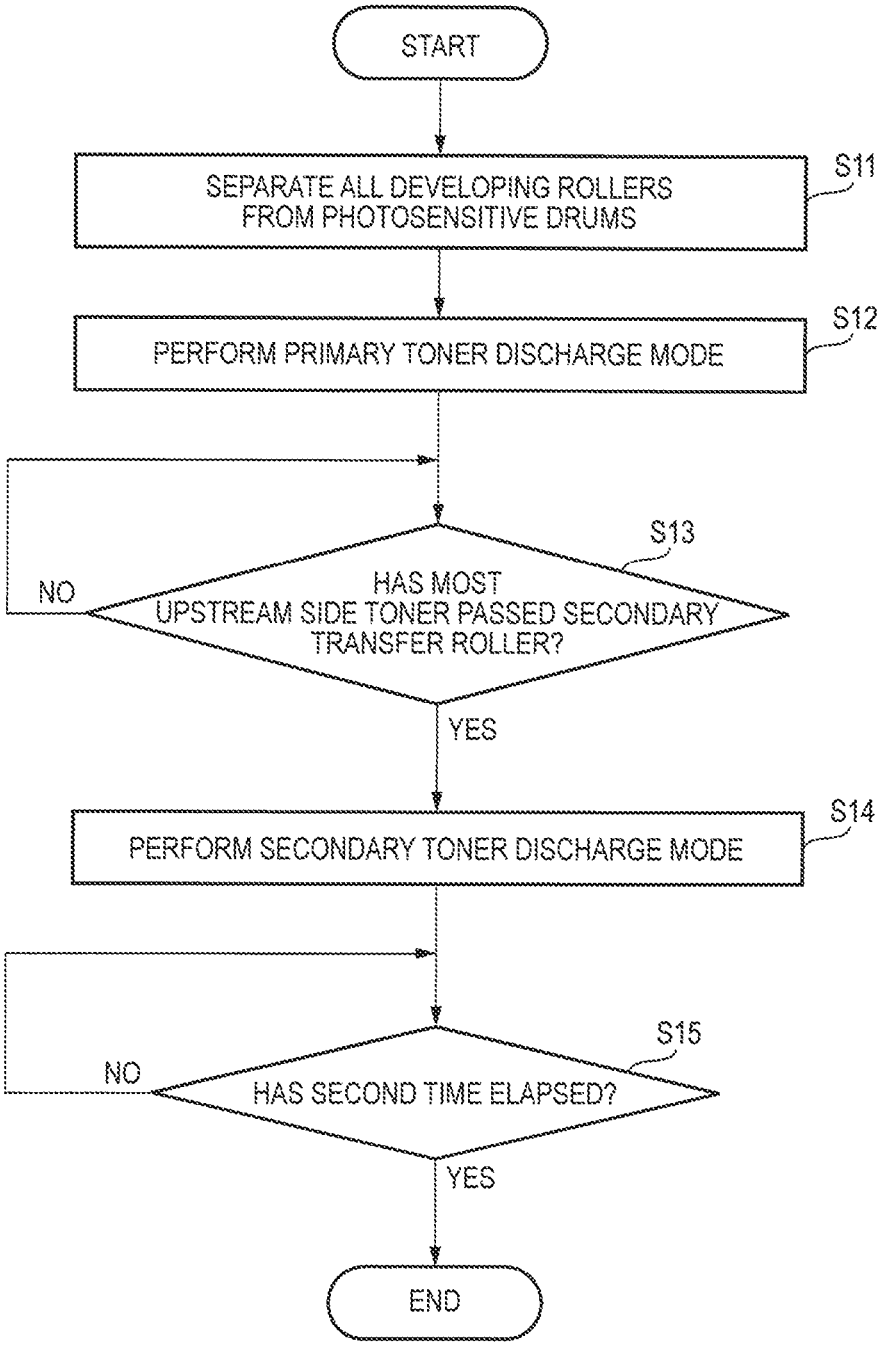
FIG. 7 is a flow chart illustrating a cleaning mode according to a second embodiment of the present invention.
Figure 9A:
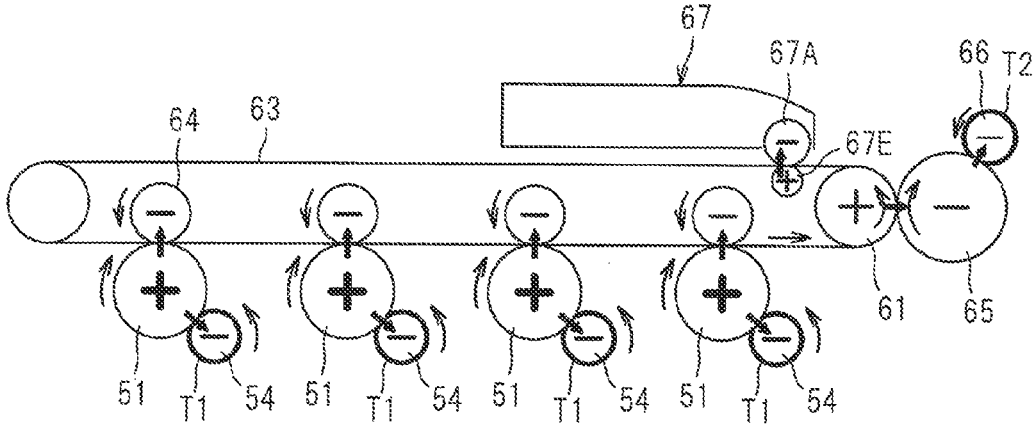
FIG. 9A is a view illustrating biases during printing control in the second embodiment.
Figure 9B:
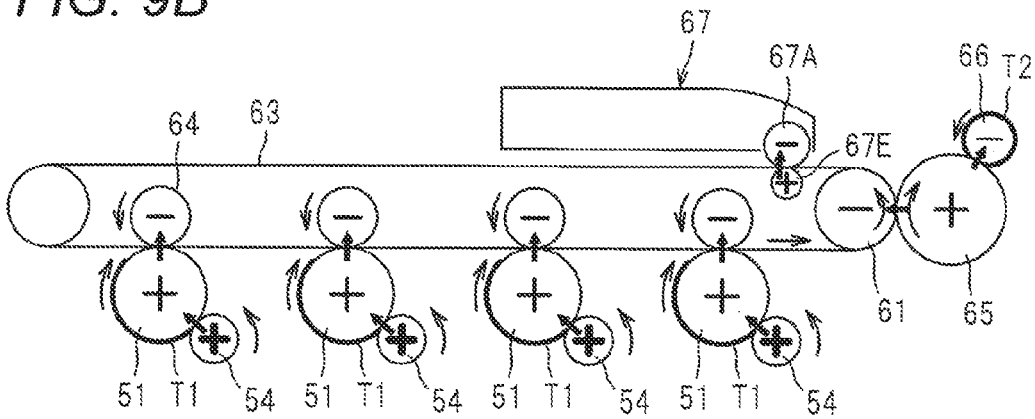
FIG. 9B is a view illustrating biases during a primary toner discharge mode in the second embodiment.

Specifically, as shown in FIG. 7, if the printing mode terminates ("START"), the control device 100 performs STEP S11 which is the same process as that of STEP S1 of the first embodiment, and then performs a primary toner discharge mode in STEP S12. In the primary toner discharge mode, the control device 100 performs control such that the primary cleaning biases and the secondary cleaning bias become the opposite polarities to those in the printing mode (see FIG. 9A) as shown in FIG. 9B. In other words, the polarity of the secondary transfer bias is reversed at a timing before toner corresponding to the first one rotation of each primary cleaning roller 54 passes the secondary transfer roller 65.

Specifically, as shown in FIG. 8, the control device 100 controls voltages to be applied to the chargers 53 such that the potential Vp of the photosensitive drums 51 becomes the potential V5 smaller than the potential V1 in the printing mode, and controls voltages to be applied to the primary cleaning rollers 54 such that the potential Vf of the primary cleaning rollers 54 becomes the positive potential V6 larger than the potential V5. Also, the control device 100 controls a voltage to be applied to the secondary transfer roller 65 such that the potential Vt of the secondary transfer roller 65 becomes the positive potential V7.

Therefore, toner T2 on the secondary cleaning roller 66 is kept on the secondary cleaning roller 66, and only toner T1 on the primary cleaning rollers 54 is discharged onto the photosensitive drums 51. Thereafter, the toner T1 is discharged from the photosensitive drums 51 onto the intermediate transfer belt 63, and then passes the secondary transfer roller 65. At this time, since the secondary transfer bias has the opposite polarity to that during printing control, the toner T1 is collected by the collecting unit 67, without being attached to the secondary transfer roller 65.

Referring to FIG. 7 again, after STEP S12, that is, after each bias corresponding to the primary toner discharge mode is set, the control device 100 performs STEP S13 which is the same process as that of STEP S5 of the first embodiment. If it is determined in STEP S13 that the most upstream side toner T1 has passed the secondary transfer roller 65 ("YES"), in STEP S14, the control device 100 performs a secondary toner discharge mode.

Figure 9C:
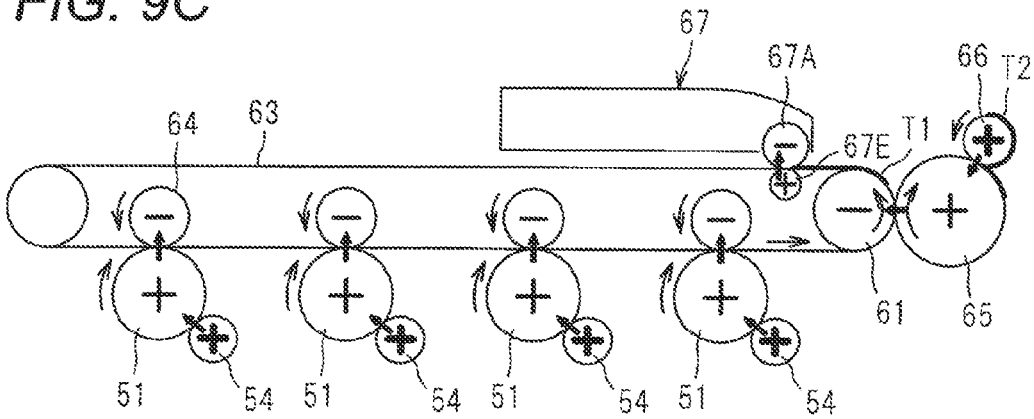
FIG. 9C is a view illustrating biases during a secondary toner discharge mode in the second embodiment.

In the secondary toner discharge mode, the control device 100 changes the potential Vs of the secondary cleaning roller 66 to the potential V8 which has the opposite polarity to that in the printing mode and is larger than the potential V7, as shown in FIGS. 8 and 9C. That is, the control device 100 changes the secondary cleaning bias to a bias larger than the secondary transfer bias. Therefore, after the toner T2 on the secondary cleaning roller 66 is discharged onto the secondary transfer roller 65, the toner T2 is then discharged onto the intermediate transfer belt 63.

Referring to FIG. 3 again, after STEP S14, that is, after each bias corresponding to the secondary toner discharge mode is set, in STEP S15, the control device 100 determines whether a second time has elapsed. Here, the second time is, for example, a time necessary for all of the toner T2 on the secondary cleaning roller 66 to be collected by the collecting unit 67 after the secondary toner discharge mode starts, and may be appropriately set by experiments, simulations, and so on.

In a case where it is determined in STEP S15 that the second time has elapsed ("YES"), the control device 100 terminates the present control.

Even in a case where the control device 100 is configured as described above, since the toner T2 from the secondary transfer roller 65 is not overlapped on the toner T1 on the intermediate transfer belt 63, which corresponds to the first one rotation of each primary cleaning roller 54 (almost all toner collected by each primary cleaning roller 54), it is possible to facilitate collecting of toner by the collecting unit 67.

Third Embodiment

Subsequently, a third embodiment of the present invention will be described in detail with reference to appropriate drawings. Also, since the present embodiment is obtained by changing the control methods of the control devices 100 according to the above described first and second embodiments, components and control steps substantially identical to those of the first and second embodiments are denoted by the same reference symbols, and will not be described in detail.

A control device 100 according to the third embodiment is configured to control each bias in a case where printing control is forcedly terminated during execution, such that toner on the secondary transfer roller 65 is moved onto the intermediate transfer belt 63 at a timing before or after a toner image having been transferred from the photosensitive drums 51 onto the intermediate transfer belt 63 passes the secondary transfer roller 65 after recovering of the color printer.

Figure 10:
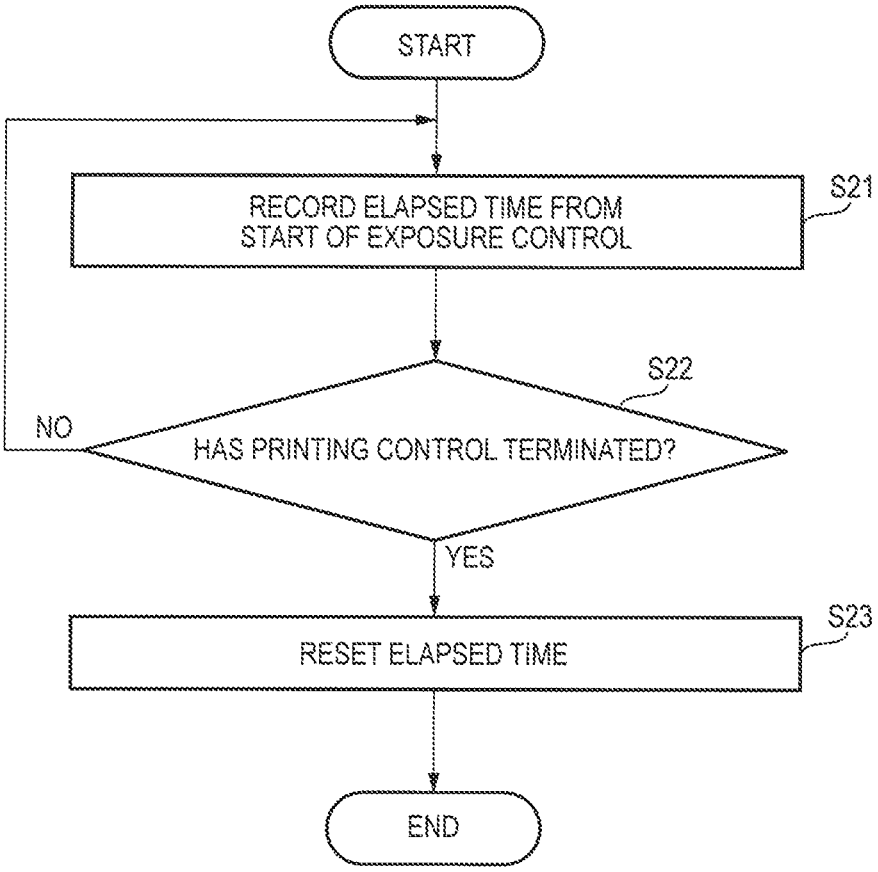
FIG. 10 is a flow chart illustrating an operation of a control device during printing control according to a third embodiment of the present invention.

Specifically, as shown in FIG. 10, if printing control starts ("START"), in STEP S21, the control device 100 records an elapsed time from start of exposure control in a storage unit. As a result, it becomes possible for the control device 100 to grasp not only the positions of electrostatic latent images on the photosensitive drums 51 but also the positions of toner images.

After STEP S21, in STEP S22, the control device 100 determines whether the printing control has terminated. In a case where it is determined in STEP S22 that the printing control has not terminated ("NO"), the control device 100 returns to STEP S21, whereas in a case where it is determined that the printing control has terminated ("YES"), the control device 100 resets the elapsed time recorded in the storage unit in STEP S23, and then terminates the present control.

As described above, since the control device 100 performs the flow chart of FIG. 10, in a case where the printing control is stopped during execution (for example, a case where a paper sheet is jammed during the printing control), the elapsed time is stored in the storage unit.

Figure 11:
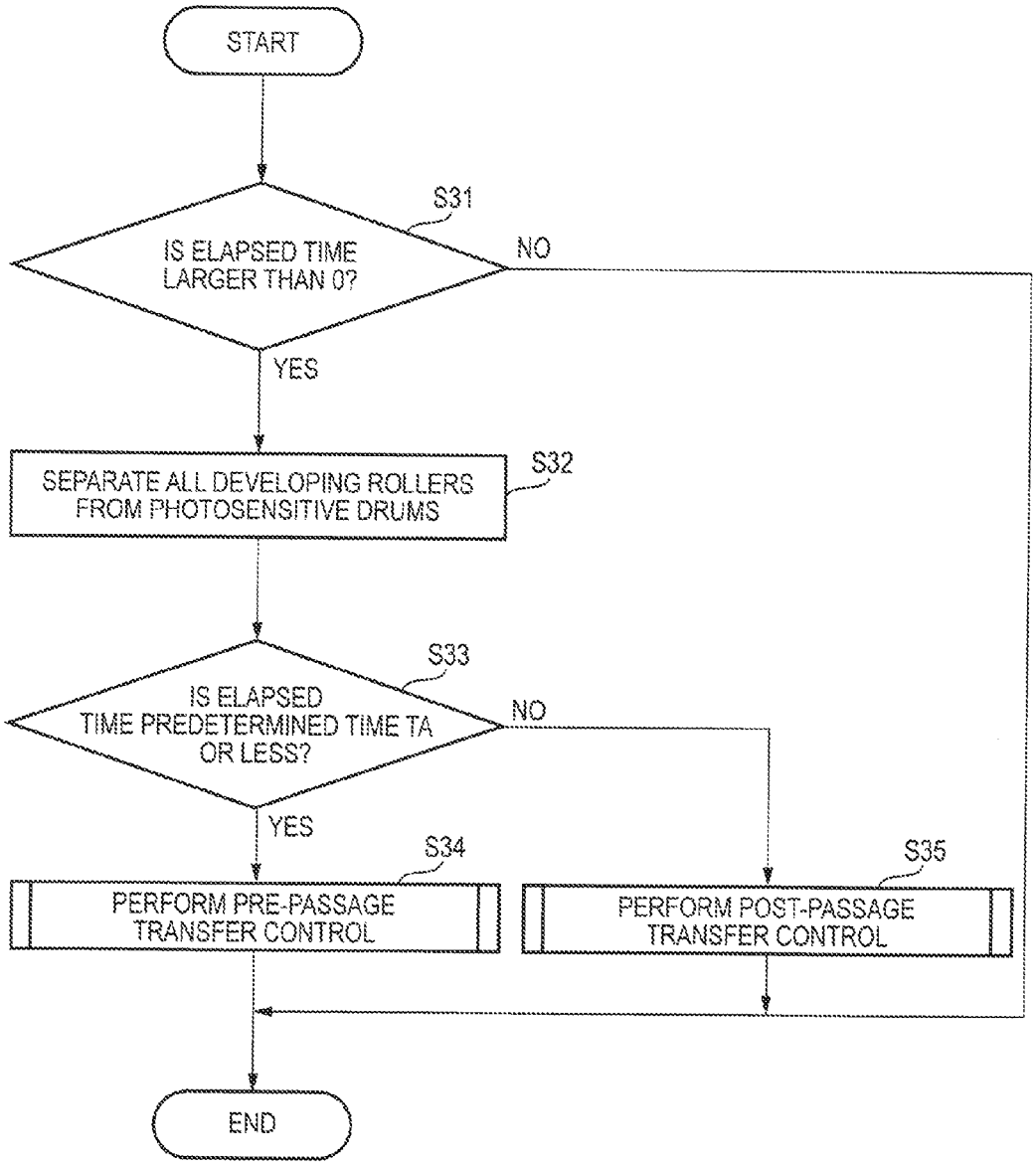
FIG. 11 is a flow chart illustrating an operation of the control device after recovering according to the third embodiment.

After recovering of the color printer 1, for example, if a power supply is turned on, the control device 100 performs a flow chart shown in FIG. 11. Specifically, if the color printer 1 is recovered ("START"), in STEP S31, the control device 100 determines whether the elapsed time is larger than 0, that is, whether any elapsed time has been recorded in the storage unit.

In a case where it is determined in STEP S31 that the elapsed time is larger than 0 ("YES"), in STEP S32, the control device 100 separates all developing rollers 55 from the photosensitive drums 51. After STEP S32, in STEP S33, the control device 100 determines whether the elapsed time is a predetermined time TA or less.

Here, the predetermined time TA is a threshold value for determining whether to set a timing to transfer the toner T2 on the secondary cleaning roller 66 onto the intermediate transfer belt 63 before or after toner images T4 on each photosensitive drum 51 (see FIG. 13A) and toner T1 on each primary cleaning roller 54 pass the secondary transfer roller 65, and may be appropriately set by experiments, simulations, and so on.

In a case where it is determined in STEP S33 that the elapsed time is the predetermined time TA or shorter ("YES"), in STEP S34, the control device 100 performs pre-passage transfer control, whereas in a case where it is determined that the elapsed time is longer than the predetermined time TA ("NO"), in STEP S35, the control device 100 performs post-passage transfer control. In the pre-passage transfer control, as shown in FIG. 12, first, in STEP S41, the control device 100 applies the same biases as those during the printing mode, to the primary transfer rollers 64 and the collecting rollers 67A and 67B.

Figure 13A:
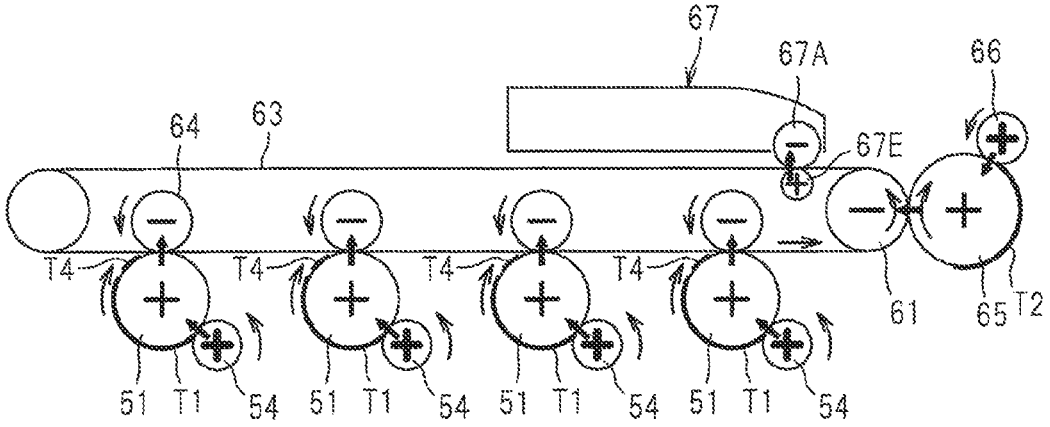
FIGS. 13A and 13B are views illustrating an operation of transferring toner on the secondary cleaning roller onto the intermediate transfer belt before toner images which were on photosensitive drums pass the secondary transfer roller.
Figure 13B:
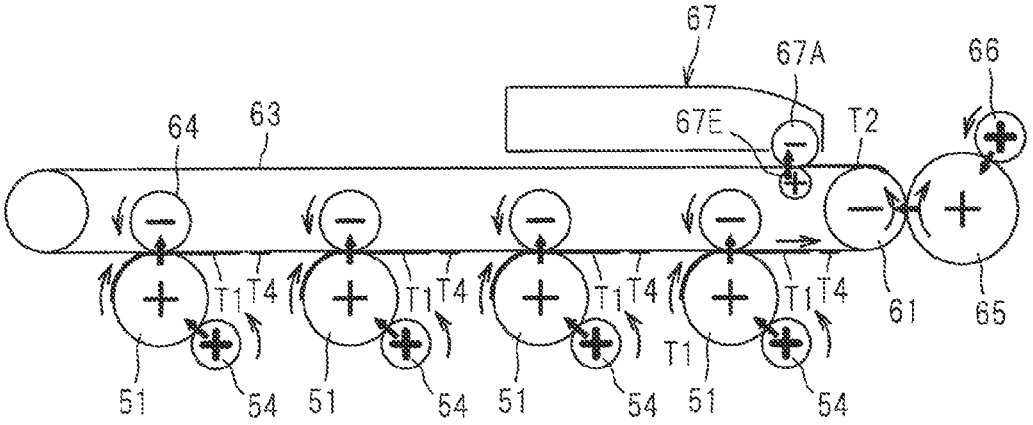

After STEP S41, the control device 100 performs the processes of STEPS S2 to S7 which are the same as those of the first embodiment. As a result, as shown in FIGS. 13A and 13B, in the pre-passage transfer control, the full discharge mode is performed. Therefore, the toner T2 on the secondary cleaning roller 66 is transferred onto the intermediate transfer belt 63 before the toner images T4 and the toner T1 which was on the primary cleaning rollers 54 pass the secondary transfer roller 65.

Figure 12:
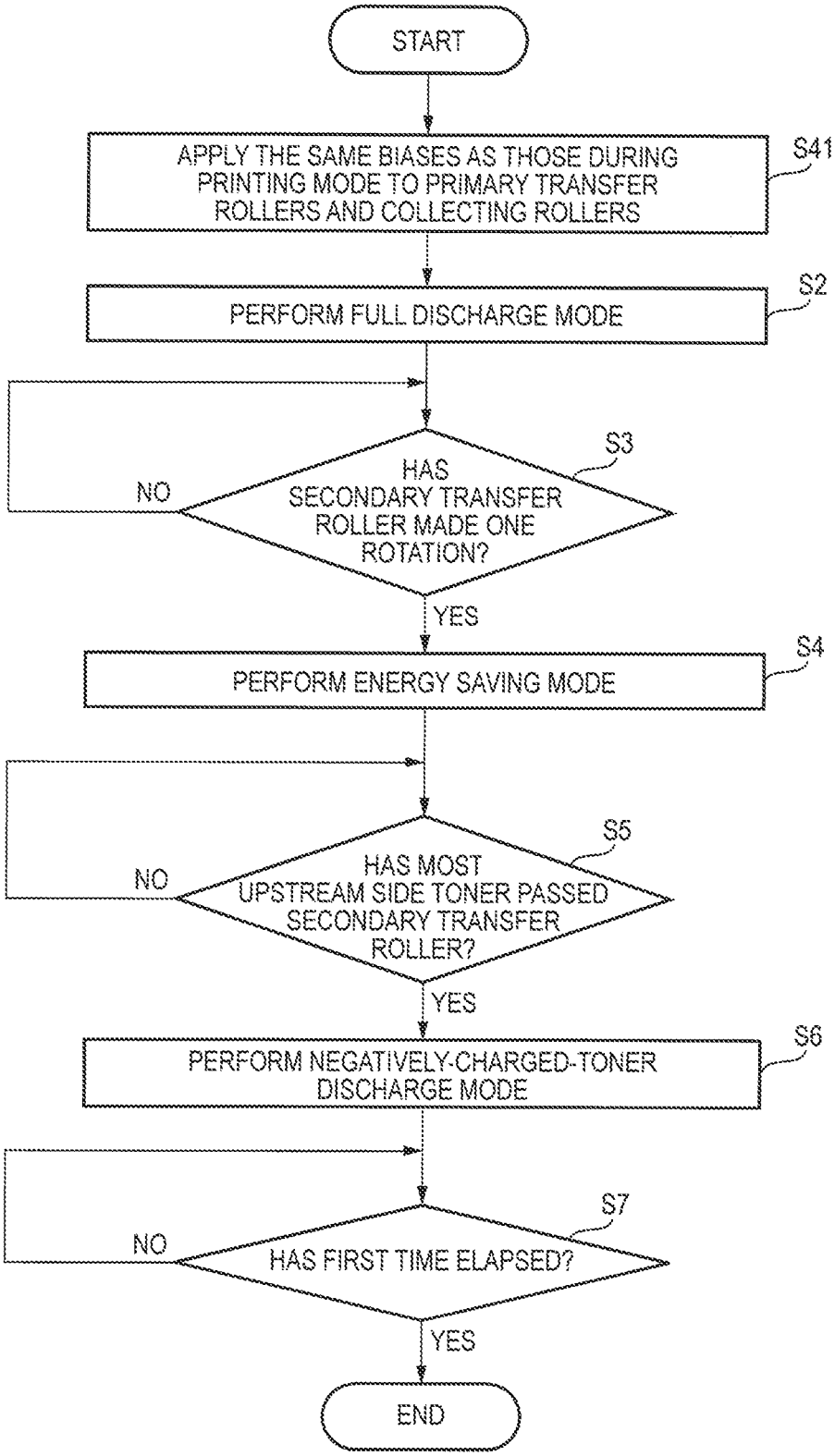
FIG. 12 is a flow chart illustrating pre-passage transfer control.
Figure 14:
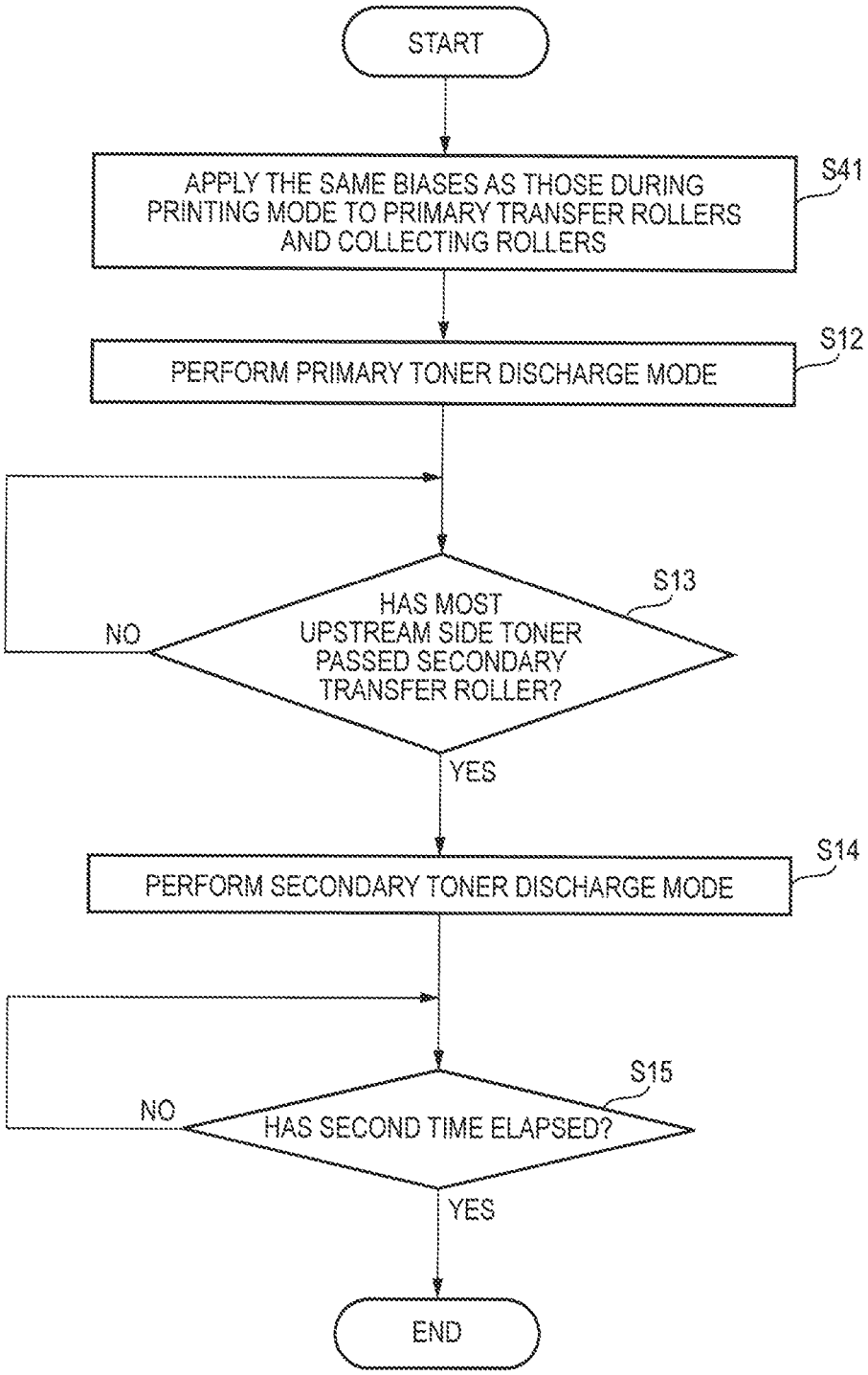
FIG. 14 is a flow chart illustrating post-passage transfer control.
Figure 15A:
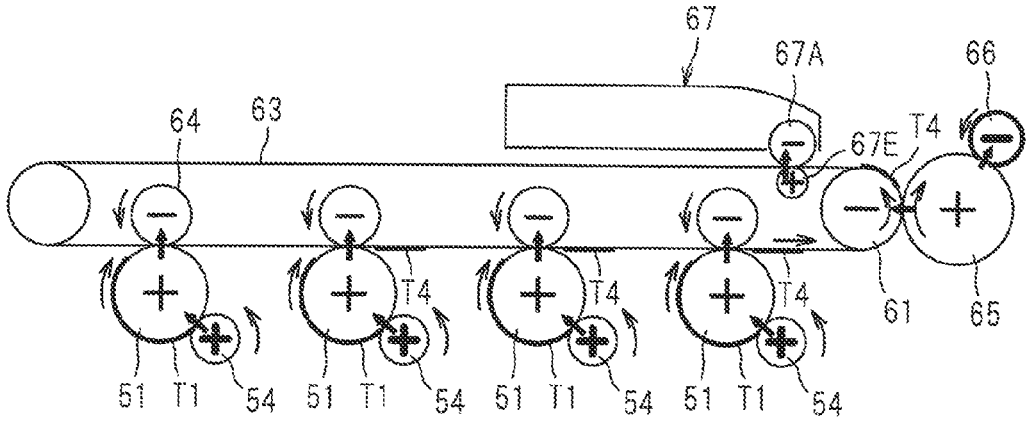
FIGS. 15A and 15B are views illustrating an operation of transferring toner on the secondary cleaning roller onto the intermediate transfer belt after all of toner which was on primary cleaning rollers has passed the secondary transfer roller.
Figure 15B:
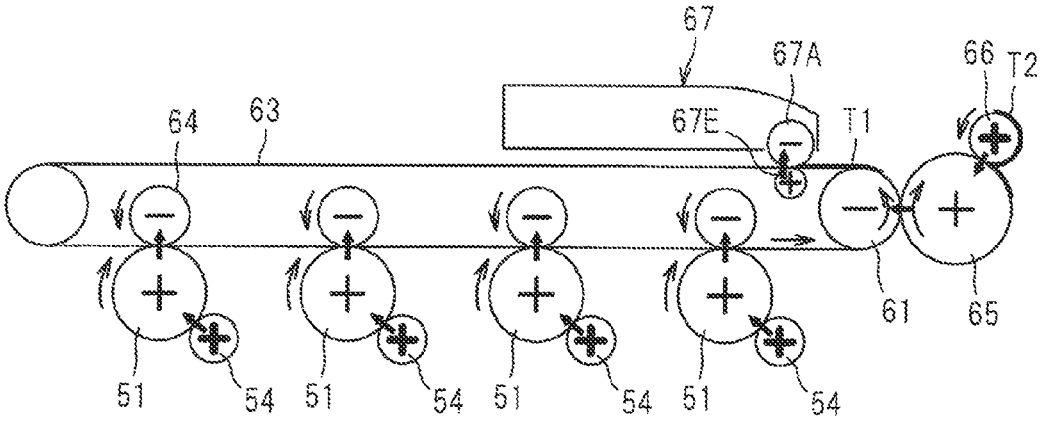

Also, in the post-passage transfer control, as shown in FIG. 14, the control device 100 first performs the process of STEP S41 which is the same as that of FIG. 12, and then performs STEPS S12 to S15 which are the same as those of the second embodiment. As a result, as shown in FIGS. 15A and 15B, in the post-passage transfer control, the toner T2 on the secondary cleaning roller 66 is transferred onto the intermediate transfer belt 63 after the toner images T4 and the toner T1 has passed the secondary transfer roller 65.

If the above described control is performed, since the toner T2 from the secondary transfer roller 65 is not overlapped on the toner images T4 and the toner T1 having been transferred onto the intermediate transfer belt 63, it is possible to facilitate collecting of toner by the collecting unit 67.

Also, the present invention is not limited to the above described embodiments, but can be used in various forms as will be exemplified hereinafter.

Figure 16:
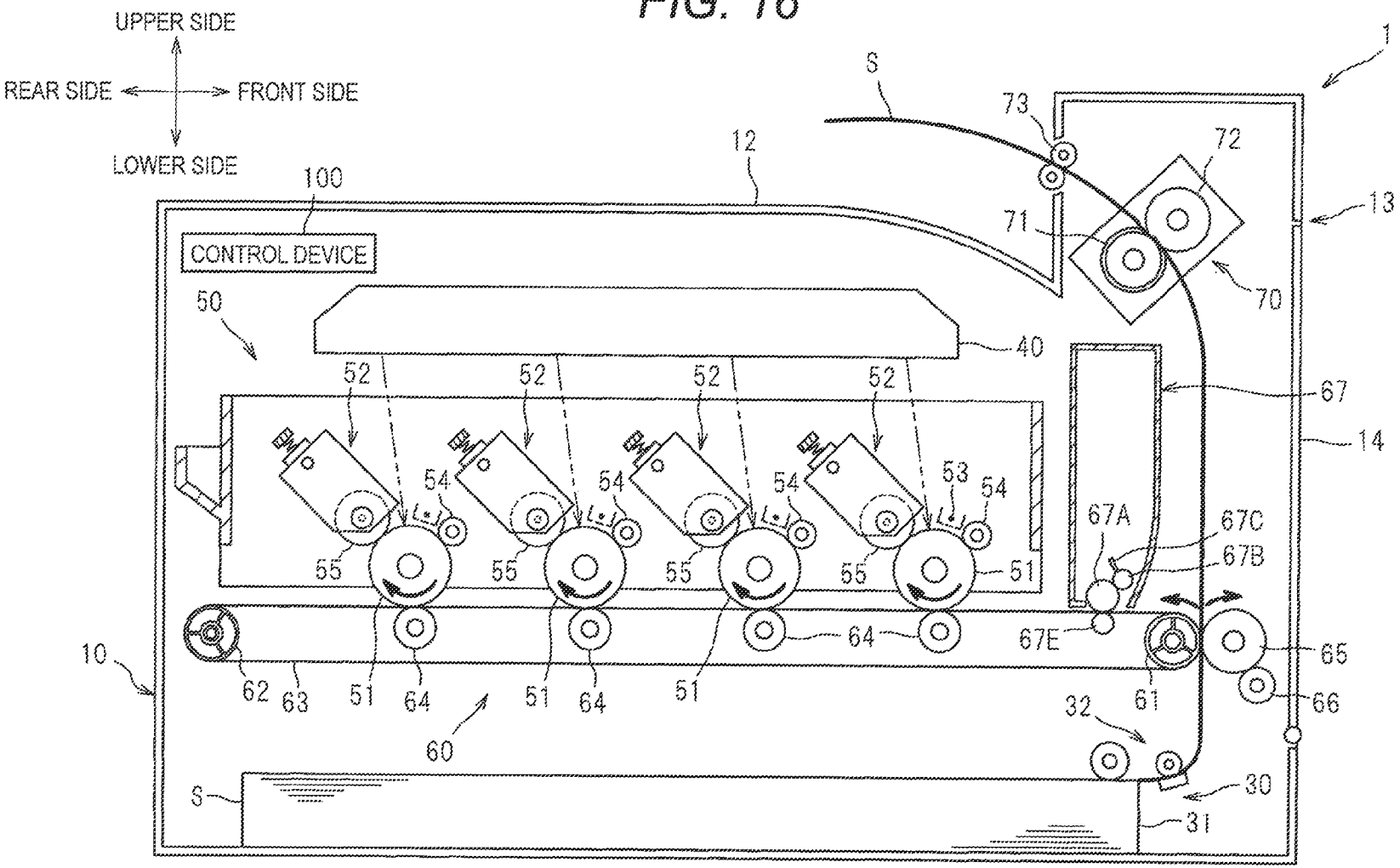
FIG. 16 is a view illustrating a form in which a plurality of photosensitive drums and a collecting unit are provided on an intermediate transfer belt.

In the above described embodiments, the plurality of photosensitive drums 51 is disposed below the intermediate transfer belt 63, and the collecting unit 67 is disposed above the intermediate transfer belt 63. However, the present invention is not limited thereto. For example, as shown in FIG. 16, both the plurality of photosensitive drums 51 and the collecting unit 67 may be disposed above the intermediate transfer belt 63. However, in a configuration as described the above described embodiments, since a gap between the most downstream side photosensitive drum 51 in the belt rotation direction and the secondary transfer roller 65 becomes short, control for preventing the toner T2 from being overlapped on the toner T1 becomes especially important.

In the above described second embodiment, the secondary cleaning bias is changed at a timing after toner corresponding to the first one rotation of each primary cleaning roller 54 has passed the secondary transfer roller 65. However, the present invention is not limited thereto. It is necessary only to move developer on the secondary holding roller onto the intermediate transfer member through the secondary transfer member at a timing after the developer corresponding to the first one rotation of each primary holding roller has passed the secondary transfer member. That is, for example, even if the bias of the secondary holding roller is reversed at a timing when developer of each primary holding roller is passing the secondary transfer member, it is necessary only for the developer of each primary holding roller to have passed the secondary transfer member while the developer of the secondary holding roller moves.

In the above described embodiments, toner is temporarily held by the secondary cleaning roller 66. However, the present invention is not limited thereto. For example, toner may be temporarily held by the secondary transfer roller.

In the above described embodiments, positively chargeable toner has been exemplified as the developer. However, the present invention is not limited thereto. For example, negatively chargeable toner may be used. Also, in a case of using negatively chargeable toner, the polarities of the above described biases need to be reversed.

In the above described embodiments, the photosensitive drums 51 have been exemplified as the photosensitive member. However, the present invention is not limited thereto. For example, a belt-like photosensitive member may be used.

In the above described embodiments, the intermediate transfer belt 63 has been exemplified as the intermediate transfer member. However, the present invention is not limited thereto. For example, a drum-shaped intermediate transfer member may be used.

In the above described embodiments, as the recording sheet, the paper sheets S such as thick paper, card, and thin paper have been exemplified. However, the present invention is not limited thereto. For example, the recording sheet may be an OHP sheet.

In the above-mentioned embodiment, the present invention has been applied to the color printer 1. However, the present invention is not limited thereto. The present invention may be applied to other image forming apparatuses, for example, copy machines, multi-function apparatuses, and so on.

The present invention provides illustrative, non-limiting examples as follows:

(1) In a first aspect, there is provided an image forming apparatus including: a plurality of photosensitive members configured to carry developer images; an intermediate transfer member configured to transfer the developer images on the plurality of photosensitive members; a secondary transfer member configured to transfer the developer images transferred onto the intermediate transfer member onto a recording sheet; a plurality of primary holding rollers provided to each of the plurality of photosensitive members, respectively, and configured to temporarily hold developer remaining on the photosensitive members; a collecting unit configured to collect developer remaining on the intermediate transfer member; and a control device configured to control biases applied to the secondary transfer member and the plurality of primary holding rollers, wherein, after printing control terminates, the control device is configured to perform cleaning control in which biases having opposite polarities to biases during the printing control are applied to the plurality of primary holding rollers and the secondary transfer member.

Here, "termination of printing control" includes not only normal termination of printing control but also forced termination of printing control due to an error occurring during the printing control.

According to the first aspect, the cleaning control for moving developer on the plurality of primary holding rollers onto the intermediate transfer member and moving developer on the secondary transfer member onto the intermediate transfer member is performed after the termination of the printing control. Accordingly, it is possible to successfully clean the developer off the photosensitive members and the secondary transfer member. Also, as compared to a configuration in which a plurality of cleaning units for collecting developer on photosensitive members (units having components such as containers for collecting toner) are provided like in the related art, since only the primary holding rollers for temporarily holding developer on the photosensitive members need to be provided, it is possible to downsize the apparatus.

(2) In a second aspect, there is provided the image forming apparatus according to the first aspect, wherein, in the cleaning control, the control device applies the bias having the opposite polarity to the bias during the printing control to the secondary transfer member at a timing before developer, which has moved onto the intermediate transfer member through each photosensitive member by a first one rotation of each of the plurality of primary holding rollers from the start of the cleaning control, passes the secondary transfer member.

According to the second aspect, since developer from the secondary transfer member is not overlapped on developer having moved onto the intermediate transfer member through each photosensitive member by the one first one rotation of each of the plurality of primary holding rollers (almost all developer collected by each primary holding roller), it is possible to facilitate collecting of developer by the collecting unit.

(3) In a third aspect, there is provided the image forming apparatus according to the second aspect, wherein, in the cleaning control, the control device applies the bias having the opposite polarity to the bias during the printing control to the secondary transfer member when the developer, which has moved onto the intermediate transfer member through each photosensitive member by the first one rotation of each of the plurality of primary holding rollers from the start of the cleaning process, passes the secondary transfer member.

According to the third aspect, it is possible to suppress developer having moved onto the intermediate transfer member through each photosensitive member by the first one rotation of each of the plurality of primary holding rollers from moving from the intermediate transfer member to the secondary transfer member.

(4) In a fourth aspect, there is provided the image forming apparatus according to any one of the first to third aspects, wherein, when moving developer on the secondary transfer member onto the intermediate transfer member, the control device applies a first bias to the secondary transfer member for a period corresponding to a first one rotation of the secondary transfer member from the start of the cleaning process, and then applies a second bias smaller than the first bias to the secondary transfer member.

According to the fourth aspect, after the secondary transfer member makes the first one rotation, the bias to be applied to the secondary transfer member is lowered from the first bias to the second bias. Therefore, for example, as compared to a configuration in which the bias is maintained after the first one rotation of the secondary transfer member, it is possible to suppress power consumption. Also, after the secondary transfer member makes the first one rotation, developer hardly remains on the secondary transfer member. Therefore, even if the bias is lowered, there is no problem.

(5) In a fifth aspect, there is provided the image forming apparatus according to any one of the second to fourth aspects, wherein, in the cleaning control, the control device applies a bias having the same polarity as the bias during the printing control to the secondary transfer member after the developer, which has moved onto the intermediate transfer member thorough each photosensitive member by the first one rotation of each of the plurality of primary holding rollers from the start of the cleaning process, has passed the secondary transfer member.

According to the fifth aspect, even in a case where the polarity of the developer having moved onto the intermediate transfer member by the first one rotation of each of the plurality of primary holding roller was reversed when the developer passes the secondary transfer member, and the developer has been reversely transferred onto the secondary transfer member, it is possible to move the reversely transferred developer from the secondary transfer member onto the intermediate transfer member and collect the developer by the collecting unit.

(6) In a sixth aspect, there is provided the image forming apparatus according to any one of the first to fifth aspects, wherein, if the printing control is forcedly terminated, after the image forming apparatus is recovered from the termination, the control device applies the bias having the opposite polarity to the bias during the printing control to the secondary transfer member at a timing before the developer images having been transferred from each photosensitive member onto the intermediate transfer member passes the secondary transfer member.

According to the sixth aspect, developer from the secondary transfer member is not overlapped on the developer having been transferred from each photosensitive member onto the intermediate transfer member. Therefore, it is possible to facilitate collecting of developer by the collecting unit.

(7) In a seventh aspect, there is provided the image forming apparatus according to the first aspect, further including: a secondary holding roller configured to temporarily hold developer remaining on the secondary transfer member, wherein, in the cleaning control, the control device applies the bias having the opposite polarity to the bias during the printing control to the secondary transfer member at a timing before developer, which has moved onto the intermediate transfer member through each photosensitive member by a first one rotation of each of the plurality of primary holding rollers from the start of the cleaning control, passes the secondary transfer member, and wherein, the control device applies a bias, which has the opposite polarity to the bias during the printing control and is larger than the bias applied to the secondary transfer member, to the secondary holding roller at a timing after the developer, which has moved onto the intermediate transfer member thorough the plurality of photosensitive members by the first one rotation of each of the plurality of primary holding rollers, passes the secondary transfer member, such that developer on the secondary holding roller moves to the intermediate transfer member through the secondary transfer member.

Even in the seventh aspect, developer from the secondary transfer member is not overlapped on the developer having moved onto the intermediate transfer member by the first rotation of each primary holding roller. Therefore, it is possible to facilitate collecting of developer by the collecting unit.

What is claimed is:

1. An image forming apparatus comprising:

a plurality of photosensitive members configured to carry developer images;

an intermediate transfer member configured to transfer the developer images on the plurality of photosensitive members;

a secondary transfer member configured to transfer the developer images transferred onto the intermediate transfer member onto a recording sheet;

a plurality of primary holding rollers provided to each of the plurality of photosensitive members, respectively, and configured to temporarily hold developer remaining on the photosensitive members;

a collecting unit configured to collect developer remaining on the intermediate transfer member; and a control device configured to control biases applied to the secondary transfer member and the plurality of primary holding rollers, wherein, after printing control terminates, the control device is configured to perform cleaning control in which biases having opposite polarities to biases during the printing control are applied to the plurality of primary holding rollers and the secondary transfer member.

2. The image forming apparatus according to claim 1, wherein, in the cleaning control, the control device is configured to apply the bias having the opposite polarity to the bias during the printing control to the secondary transfer member at a timing before developer, which has moved onto the intermediate transfer member through each photosensitive member by a first one rotation of each of the plurality of primary holding rollers from the start of the cleaning control, passes the secondary transfer member.

3. The image forming apparatus according to claim 2, wherein, in the cleaning control, the control device is configured to apply the bias having the opposite polarity to the bias during the printing control to the secondary transfer member when the developer, which has moved onto the intermediate transfer member through each photosensitive member by the first one rotation of each of the plurality of primary holding rollers from the start of the cleaning control, passes the secondary transfer member.

4. The image forming apparatus according to claim 2, wherein, in the cleaning control, the control device is configured to apply a bias having the same polarity as the bias during the printing control to the secondary transfer member after the developer, which has moved onto the intermediate transfer member through each photosensitive member by the first one rotation of each of the plurality of primary holding rollers from the start of the cleaning control, has passed the secondary transfer member.

5. The image forming apparatus according to claim 1, wherein, when moving developer on the secondary transfer member onto the intermediate transfer member, the control device is configured to apply a first bias to the secondary transfer member for a period corresponding to a first one rotation of the secondary transfer member from the start of the cleaning control, and then apply a second bias smaller than the first bias to the secondary transfer member.

6. The image forming apparatus according to claim 1, wherein, if the printing control is forced to terminate, after the image forming apparatus is recovered from the termination, the control device is configured to apply the bias having the opposite polarity to the bias during the printing control to the secondary transfer member at a timing before the developer images having been transferred from each photosensitive member onto the intermediate transfer member pass the secondary transfer member.

7. The image forming apparatus according to claim 1, further comprising:

a secondary holding roller configured to temporarily hold developer remaining on the secondary transfer member, wherein, in the cleaning control, the control device is configured to apply the bias having the opposite polarity to the bias during the printing control to the secondary transfer member at a timing before developer, which has moved onto the intermediate transfer member through each photosensitive member by a first one rotation of each of the plurality of primary holding rollers from the start of the cleaning control, passes the secondary transfer member, and wherein, the control device is configured to apply a bias, which has the opposite polarity to the bias during the printing control and is larger than the bias applied to the secondary transfer member, to the secondary holding roller at a timing after the developer, which has moved onto the intermediate transfer member through the plurality of photosensitive members by the first one rotation of each of the plurality of primary holding rollers, passes the secondary transfer member, such that developer on the secondary holding roller moves to the intermediate transfer member through the secondary transfer member.

* * * * *